United States Patent [19]

Takahashi et al.

[11] 4,385,558

[45] May 31, 1983

[54] INK AMOUNT DETECTING DEVICE

[75] Inventors: Yasuhiro Takahashi, Toyko; Yoshiharu Ohinata, Kawasaki, both of Japan

[73] Assignee: Riso Kagaku Corporation, Tokyo, Japan

[21] Appl. No.: 266,452

[22] Filed: May 22, 1981

Related U.S. Application Data

[63] Continuation of Ser. No. 77,546, Sep. 21, 1979, abandoned.

[30] Foreign Application Priority Data

Oct. 18, 1978 [JP] Japan ..... 53-128044

[51] Int. Cl.[3] ..... B41F 31/06

[52] U.S. Cl. ..... 101/120; 101/363

[58] Field of Search ..... 101/350, 363, 364, 119, 101/120, 207, 208, 210, 366; 137/101.25, 101.27, 386, 413; 73/305-308, 317; 222/64, 65-69; 200/81.9 R, 84 B

[56] References Cited

U.S. PATENT DOCUMENTS

| | | | |
|---|---|---|---|
| 2,399,688 | 5/1946 | Metzner et al. | 101/364 |
| 3,373,052 | 3/1968 | Rode | 101/350 X |
| 3,730,089 | 5/1973 | McCutcheon | 101/363 |

*Primary Examiner*—J. Reed Fisher

*Attorney, Agent, or Firm*—Birch, Stewart, Kolasch & Birch

[57] ABSTRACT

A printing machine such as a stencil duplicator having an ink supply roller and a squeezer and adapted to hold a columnar ink deposit placed on the outer peripheral surface of the roller and substantially prevented by the squeezer from moving as a whole together with the outer peripheral surface of the roller, including a device for detecting the amount of ink in the ink deposit, having a pivotable lever whose one end contacts the ink deposit and which changes its pivotal position in accordance with the size of the ink deposit, and a means for detecting the pivotal position of the lever.

5 Claims, 8 Drawing Figures

INK AMOUNT DETECTING DEVICE

This application is a continuation, of copending application Ser. No. 77,546, filed on Sept. 21, 1979, now abandoned.

BACKGROUND OF THE INVENTION

The present invention relates to an ink amount detecting device, for use, in particular, in a stencil duplicator.

In a co-pending patent application filed for the same assignee as the present application, Ser. No. 77,547, a stencil duplicator has been proposed, which comprises a porous cylindrical drum which is supported to rotate around its central axis and is adapted to support a stencil sheet wrapped around it, an ink supply roller which is supported so as to rotate around its central axis arranged in parallel to the central axis of said drum with part of its outer peripheral surface being kept in contact with part of the inner peripheral surface of said drum, a means for supplying continuously an ink layer of a predetermined thickness onto the outer peripheral surface of said roller only when said roller rotates, and a means for exerting pressing force against the part of the outer peripheral surface of said drum which is opposite to the part of the inner peripheral surface of said drum at which said ink supply roller contacts said drum. In this connection, in the copending patent application, as the means for supplying continuously an ink layer of a predetermined thickness onto the outer peripheral surface of the ink supply roller, it has been proposed to provide an ink deposit on the outer peripheral surface of the ink supply roller and to provide a squeeze element such as a squeeze roller in close proximity to the outer peripheral surface of the ink supply roller so as substantially to prevent the ink deposit from being transferred together with the outer peripheral surface of the ink supply roller as it rotates, so that ink delivered through a thin clearance formed between the ink supply roller and the squeeze element forms the ink layer of a predetermined thickness to be provided on the outer peripheral surface of the ink supply roller.

The present invention relates, in particular, to the means for supplying continuously an ink layer of a predetermined thickness onto the outer peripheral surface of the ink supply roller in a stencil duplicator such as claimed in the aforementioned co-pending patent application, and still in particular, the present invention is concerned with detecting the amount of ink in the above-described ink deposit provided on the outer peripheral surface of the ink supply roller, for the purpose of controlling the amount of ink supplied to the ink deposit. As described in the specification of the aforementioned co-pending patent application, in order to obtain a large number of highly uniform and high quality copies by stencil duplication, it is very important that the ink supply roller is supplied with an ink layer of an accurately controlled thickness, and in order to accomplish this it is also important that the ink deposit is definitely maintained within a certain size range. In order to control the size of the ink deposit, a device which is able to detect the amount of ink or the size of the ink deposit at high accuracy and quickness is required.

SUMMARY OF THE INVENTION

It is, therefore, the object of the present invention to provide a device for detecting the amount of ink in an ink deposit which is provided on the outer peripheral surface of an ink supply roller adapted to rotate around its central axis and wherein the ink is substantially controlled by a squeeze element as to the amount transferred to the outer peripheral surface of said ink supply roller when it rotates, in a simple but reliably operating structure.

In accordance with the present invention, the above-mentioned object is accomplished by a device for detecting the amount of ink in an ink deposit under the aforementioned condition, comprising a lever supported at a portion thereof so as to be pivotable around an axis which is substantially parallel with the central axis of said ink supply roller, one end of said lever being positioned so as to interfere with and be driven by the ink deposit in accordance with the size of the ink deposit, and a means which detects pivoting action of said lever.

When the ink supply roller rotates in operation around its central axis with an ink deposit provided on its outer peripheral surface, the amount of ink being transferred to the outer peripheral surface of the ink supply roller being substantially controlled by a squeeze element, the ink of the ink deposit circulates, in a columnar shape, around its axial core portion by the force transmitted principally from the outer peripheral surface of the ink supply roller to the lower portion of the ink deposit, in a general rotational direction opposite to the rotational direction of the ink supply roller. Therefore, when one end of the lever, which is supported so as to be rotatably mounted around an axis which is substantially parallel with the central axis of the ink supply roller, touches the ink deposit in a manner of dipping into it, the end of the lever is exerted with relatively strong force from the circulating ink, so that the lever is given a torque which will rotate the lever around its pivotal axis. Therefore, if the lever is properly balanced around its pivoting axis by, for example, a counterweight, the lever takes two definitely pivoted positions according to whether its said one end is in contact with the ink deposit or not. Further, since the ink deposit circulating or churning in a columnar shape around its central core portion presents a relatively rigid peripheral portion due to the balance of centrifugal force and surface tension, if an end of the lever is placed in contact with an outer peripheral portion of the columnar ink deposit, it is shoved aside by the rotating mass of the ink deposit.

When a relatively viscous ink, such as described in the aforementioned co-pending patent application, is used in stencil duplication performed by employing the device of the present invention, relatively strong force can be exerted to the end of the lever in accordance with the size of the ink deposit, and therefore if the balance of the lever around its pivoting axis is judiciously designed, a motive displacement of the lever enough to actuate a microswitch is readily available, so that electrical on and off signals, which are useful for controlling supply of ink to the deposit, may be directly obtained by the simple combination of a pivotable lever and a microswitch.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DESCRIPTION OF THE PREFERRED EMBODIMENTS

Figure 1:
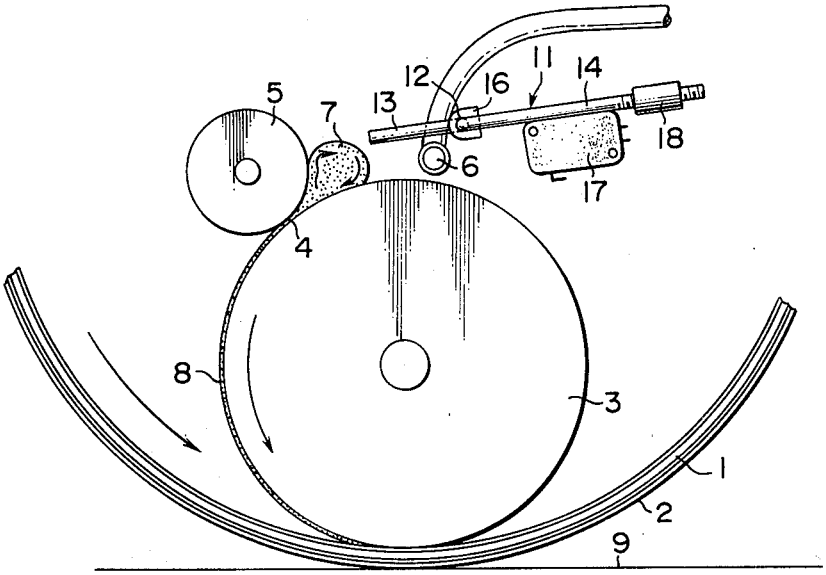
FIG. 1 is a diagrammatical sectional view showing an embodiment of the device of the present invention incorporated in a single drum type stencil duplicator, in the condition where the ink deposit is smaller than a predetermined size, the section being taken perpendicularly to the axis of the drum.
Figure 2:
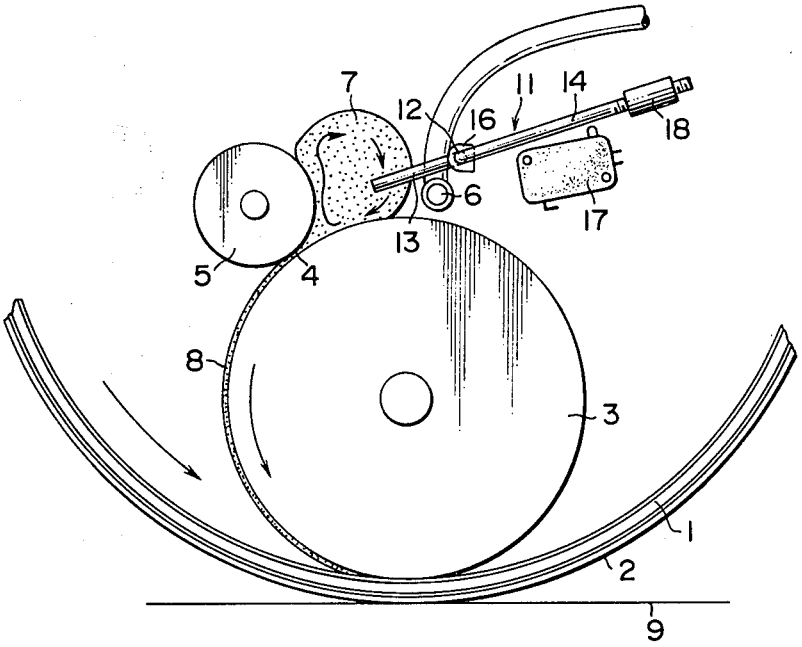
FIG. 2 is a view similar to FIG. 1, showing the device in the condition where the ink deposit is larger than a predetermined size.
Figure 3:
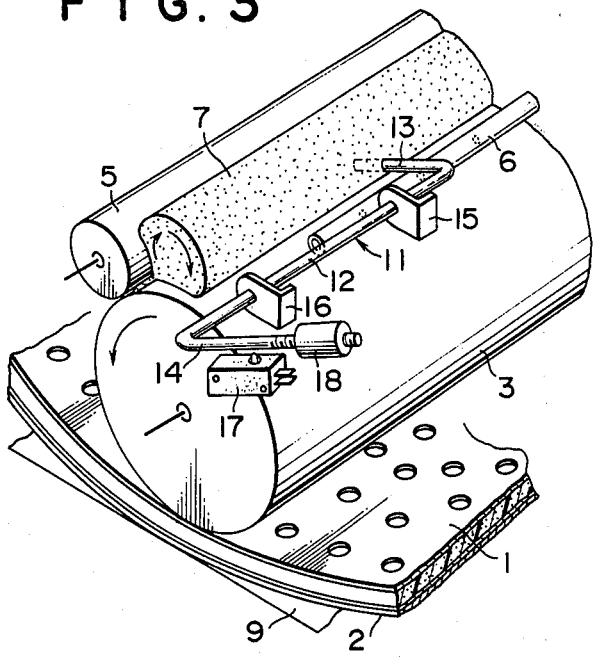
FIG. 3 is a perspective view showing the device in the condition shown in FIG. 2.

Referring first to FIGS. 1–3, showing the first embodiment, 1 designates a porous cylindrical drum which is supported so as to rotate in the anticlockwise direction as viewed in FIGS. 1 and 2 around its central axis by being driven by an electric motor not shown in the figures. In operation, a perforated stencil sheet 2 is mounted around the drum. Within the cylindrical drum 1 is mounted an ink supply roller 3, which is supported so as to rotate around its central axis with part of its outer peripheral surface being kept in contact with part of the inner peripheral surface of the drum 1, and is adapted to rotate in the same direction as the drum 1 when the drum rotates, depending upon frictional engagement between the roller and the drum.

In the cylindrical drum 1 and in close proximity to an upper part of the outer peripheral surface of the ink supply roller 3 is provided a squeeze roller 5, so as to rotate around its central axis arranged in parallel with the central axis of the roller 3, and so as to define a thin clearance 4 between the rollers 3 and 5. To the wedge-shaped space formed between the rollers 3 and 5 at the leading side of the clearance 4 as viewed in the rotating direction of the roller 3 is supplied ink by an ink distributing pipe 6, so that an ink deposit 7 is formed in the wedge-shaped space defined between the rollers 3 and 5. The ink of the ink deposit 7 circulates around its axial core portion in the clockwise direction as viewed in FIGS. 1 and 2 and as shown by arrows in these figures when the ink supply roller 3 rotates in the anticlockwise direction as viewed in these figures, due to the force transmitted from the outer peripheral surface of the drum 3 to the bottom portion of the ink deposit by contact therewith and viscosity of the ink. Because of this rotation of the ink, the supply of ink to a portion of the columnar ink deposit is quickly distributed uniformly over the entire length of the ink deposit. While rotating, a portion of the ink of the ink deposit is squeezed out through the clearance 4 out of the wedge-shaped space so as to form an ink layer 8 having a predetermined thickness on the outer peripheral surface of the ink supply roller 3. As the ink supply roller 3 rotates, the ink layer 8 is transferred to the region where the ink supply roller 3 contacts with the drum 1, where the ink layer 8 is pressed between the roller 3 and the drum 1, and, if the stencil sheet 2 mounted around the drum 1 has perforations at a portion where the compression of ink occurs, ink is transferred through the perforations towards the outside of the stencil sheet 2, so as to be transferred onto a printing sheet 9 which is brought into contact with the outer surface of the stencil sheet 2 in the region where the compression of ink takes place.

The amount of ink in the ink deposit 7 is detected by the ink amount detecting device of the present invention. This device includes a lever 11, which is supported at its pivot portion 12 by brackets 15 (not seen in FIGS. 1 and 2) and 16, so as to be pivotable around an axis which is substantially parallel to the central axis of the ink supply roller 3. An arm portion 13 of the lever extending on one side of its pivot portion 12 is directed toward the wedge-shaped space in which the ink deposit 7 is formed, and the tip end of the arm portion 13 is located at such a position that it will interfere with the ink deposit 7 when the ink deposit 7 becomes larger than a predetermined size. The other arm portion 14 of the lever which extends on the opposite side of the arm portion 13 from the pivot portion 12 is adapted to selectively actuate a microswitch 17 according to its pivoting action around the pivot portion 12. A weight 18 is mounted to the arm portion 14 adjacent its tip end.

When the ink deposit 7 is smaller than a predetermined size, as shown in FIG. 1, so that the end of the arm portion 13 is not in touch with the ink deposit 7, the lever 11 is pivoted clockwise as viewed in FIG. 1 due to unbalance of the lever around the pivot portion 12 and the weight 18 mounted adjacent to the tip end of the arm portion 14, thereby pressing the contact point of the microswitch 17 so as to turn it on. When the switch 17 is turned on, it energizes an ink feed pump not shown in the figure, so as to supply ink through the ink supply pipe 6, so that ink is delivered toward the ink deposit 7.

When ink is supplied to the ink deposit 7, it gradually grows larger, and finally comes in contact with the tip end of the arm portion 13 of the lever 11. When the interference between the ink deposit 7 and the arm portion 13 of the lever once occurs, it proceeds so far as shown in FIG. 2, where the end of the arm portion 13 deeply dips into the ink deposit as it is strongly driven downward in the figure by the circulating relatively viscous ink of the ink deposit 7, whereby the lever 11 is pivoted around its pivot portion 12 anticlockwise as viewed in FIG. 2, so as to release the contact point of the microswitch 17, so that the switch 17 is now turned off. By the microswitch 17 being turned off, the aforementioned ink feed pump is stopped, and the supply of ink to the ink deposit 7 is stopped. After this, the ink deposit 7 becomes gradually smaller as the ink of the deposit is gradually fed out in the form of the ink layer 8 provided on the outer peripheral surface of the ink supply roller 3.

When the ink deposit 7 has become so small that it comes out of interference with the tip end of the arm 13, or, although it may still be in contact with the tip portion of the arm portion 13, when the circulating ink can no longer maintain the lever 11 in the anticlockwise pivoted condition as shown in FIG. 2 against the torque applied to the lever 11 around its pivot portion 12, effected by the unbalance of the lever 11 around its pivot portion 12 and the weight 18, and lever 11 is pivoted clockwise around its pivot portion 12 so as to come to the position shown in FIG. 1, at which it actuates the contact point of the microswitch 17 so as to turn it on. Then, the aforementioned ink feed pump is restarted, and supply of ink to the ink deposit 7 is resumed. In this connection, since there exists some delay between actual stopping and restarting of the supply of ink to the ink deposit 7 and turning on and off of the microswitch 17, and since the size of the ink deposit at which the end of the lever comes out of contact with the ink deposit is somewhat smaller than the size of the ink deposit at which the end of the lever comes into contact with the ink deposit, a proper hysteresis is provided in the on and off control of the size of the ink deposit. By this arrangement, the size of the ink deposit is maintained within a predetermined range.

Figure 4:
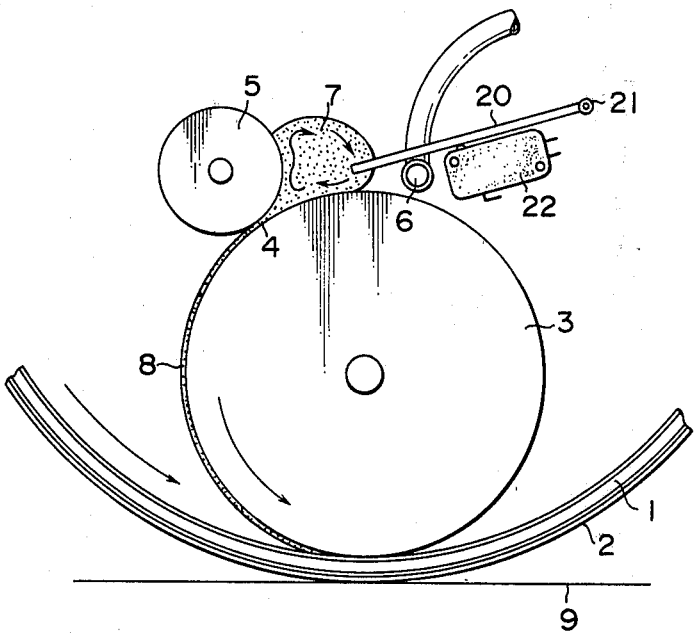
FIG. 4 is a view similar to FIG. 2, showing another embodiment of the device of the present invention.

In FIG. 4 is shown a second embodiment of the present invention in the same manner as in FIG. 2. In this embodiment, the lever 20, which is pivotably supported at its pivot portion 21 located at its one end and touches the ink deposit 7 at its other free end, is adapted to push the contact point of a microswitch 22 when the tip end of the lever has come in touch with the ink deposit 7. In this case, if the microswitch 22 is constructed so as to be turned on when its contact point is released, and so as to be turned off when its contact point is pushed, this microswitch may be incorporated in an electric circuit for controlling the ink feed pump in the same manner as the microswitch 17. By contrast, if the microswitch 22 has the same construction as the microswitch 17, an inverting circuit will be required in the electric circuit for the pump. Further, in this embodiment it is required that the lever 20 be rather light in weight, so that when its free end is not in touch with the ink deposit 7, the contact point of the microswitch 22 can return to its released position by its spring force against the weight of the lever 20.

Figure 5:
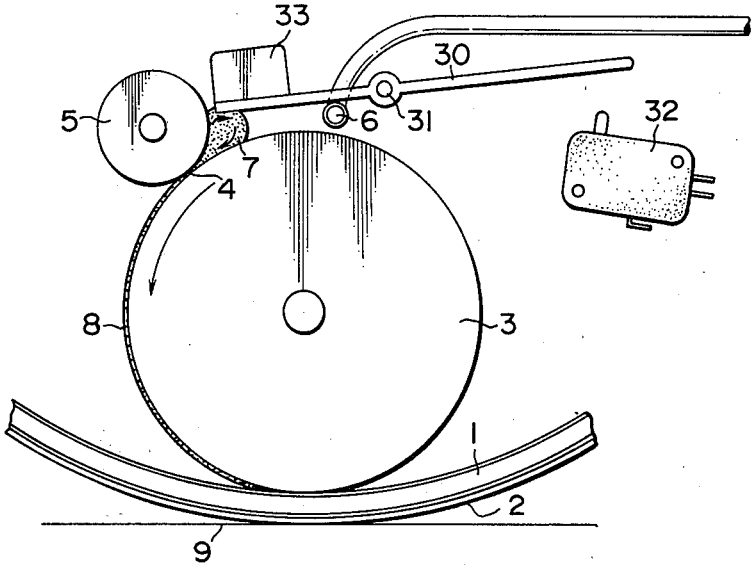
FIG. 5 is a view similar to FIG. 1, showing still another embodiment of the device of the present invention, in a first operational condition.
Figure 6:
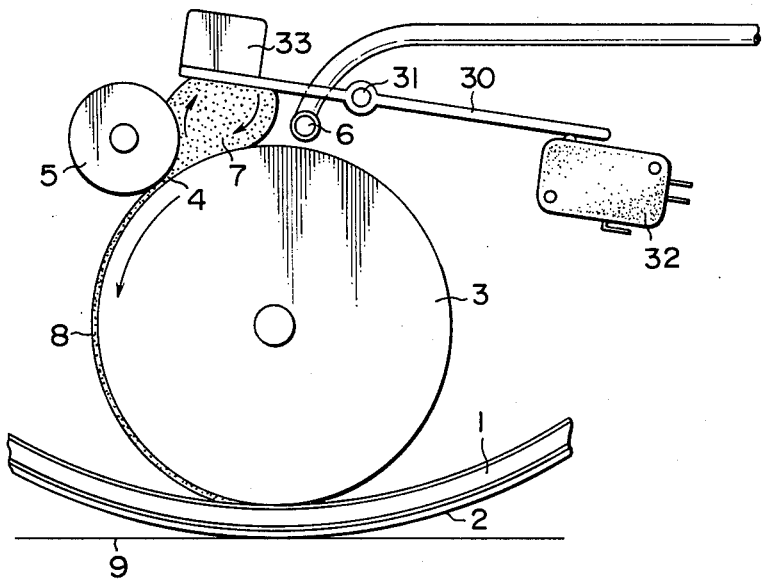
FIG. 6 is a view similar to FIG. 5, showing the device in a second operating condition.

FIGS. 5 and 6 show a still further embodiment of the device of the present invention in two different operating conditions, analogous to FIGS. 1 and 2. In this embodiment, an end of a lever 30 which is pivotably supported by a pivot 31 and has a weight 33 mounted at its said one end is adapted to touch but not dip into the rotating ink deposit 7, regardless of its size, during operation of the duplicator. In this case, when the ink deposit 7 is smaller than a predetermined size, the other end of the lever 30 is removed from the contact point of the microswitch 32. By contrast, when the ink deposit 7 becomes larger than a predetermined size, the other end of the lever 30 pushes the contact point of the microswitch 32. Therefore, the operating manner of this embodiment is the same as that of the embodiment shown in FIG. 4. In this embodiment, the end of the lever 30 which touches the ink deposit 7 is so designed that it does not dip into it, and so the lever is not sensitive to the circulation of the ink in the ink deposit, but is sensitive to the overall size of the ink deposit. This is possible because the columnar circulating or churning ink deposit presents a relatively rigid outer peripheral portion due to the balance of centrifugal force and surface tension.

Figure 7:
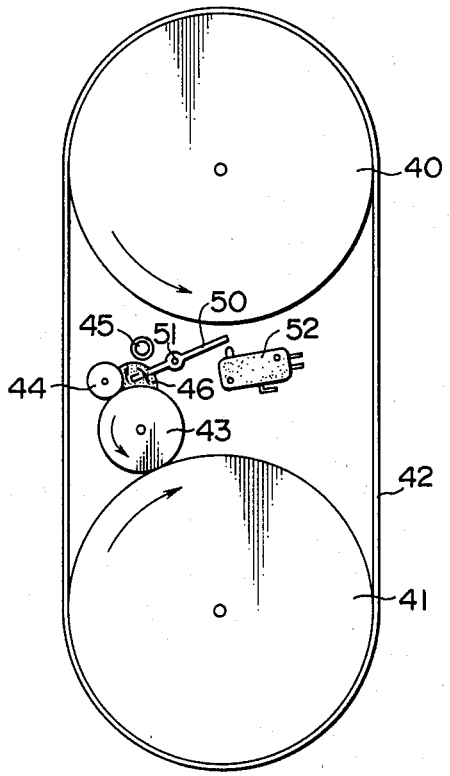
FIG. 7 is a diagrammatical sectional view of an embodiment of the device of the present invention incorporated in a dual drum type stencil duplicator, showing the device in a first operating condition, and taken perpendicularly to the drums.
Figure 8:
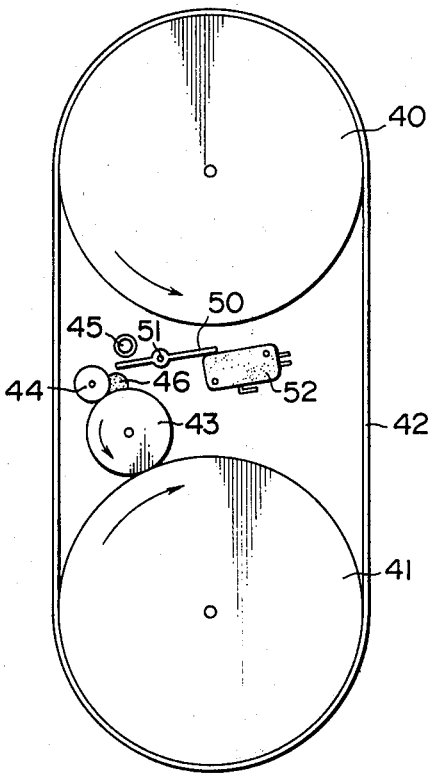
FIG. 8 is a view similar to FIG. 7 showing the device in a second operating condition.

FIGS. 7 and 8 show an embodiment of the device of the present invention which is incorporated in a dual drum type stencil duplicator having drums 40 and 41 and a screen belt 42 mounted around these two drums. In the condition shown in FIG. 7, the ink deposit 46 provided in the wedge-shaped space formed between an ink supply roller and a squeeze roller 44 has exceeded a predetermined size, so that one end of the lever 50 supported by a pivot shaft 51 is in touch with the ink deposit, whereby the other end of the lever is removed from the contact point of a microswitch 52. In this condition, an ink feed pump which is not shown in the figure and which supplies ink to an ink supply pipe 45 is stopped.

By contrast, in the condition shown in FIG. 8, the ink deposit 46 has become smaller than an predetermined size, so that the end of the lever 50 is removed from contact with the ink deposit, and is pivoted around the pivot shaft 51 in the clockwise direction as viewed in FIG. 8 so as to push the contact point of the microswitch 52. In this condition, the aforementioned ink feed pump is energized, so as to supply ink to the ink supply pipe 45, from which ink is delivered to the ink deposit 46.

Although the pivoting action of the lever is detected by a microswitch in the above explained four embodiments, it may be detected by other means such as a differential transformer, or a photoelectric means. Further, the ink amount detecting device of the present invention may also be applied to other printing machines, like offset printing machines and the like.

Although the invention has been shown and described with respect to some preferred embodiments thereof, it should be understood that various changes and modifications to the form of any particular embodiment thereof may be made by one skilled in the art, without departing from the scope of the invention.

We claim:

1. A device for detecting the amount of ink disposed in an ink deposit provided along a linear corner space defined by the outer peripheral surface of an ink supply roller adapted to rotate around its central axis and a squeeze element arranged in parallel with the central axis of said ink supply roller in close proximity to said outer peripheral surface while leaving a small linear clearance there-between through which ink from the ink deposit is taken out in the form of a thin ink layer formed on the outer peripheral surface of said ink supply roller as it rotates, said ink deposit being thereby formed into a columnar shape having a curved surface which rotates around its axial core portion, comprising a lever supported at a portion thereof so as to be pivotable around an axis which is substantially parallel with the central axis of said ink supply roller, said lever and said pivotal portion being positioned relative to said linear corner space so that one end of said lever extends into and is driven by the rotating columnar ink deposit when the cross-sectional size of the ink deposit has exceeded a predetermined size and that, when said one end of said lever has once been caught and driven by said rotating columnar ink deposit during its growth, thereby pivoting said lever around said pivotal portion, said one end of said lever comes closer to said core portion of said rotating columnar ink deposit, thereby instantaneously substantially increasing the depth of thrusting of said one end of said lever into said ink deposit due to said curved surface thereof and thereby providing a hystersis large enough to insure stable operation of the device even with a pivoting action of relatively small angle of said lever, and a means for detecting the pivoting action of said lever.

2. The device of claim 1, wherein said lever pivoting action detecting means is a microswitch which has a contact point actuated by said lever.

3. The device of claim 1, wherein said lever is pivoted against the force of gravity when its one end is in contact with said ink deposit.

4. The device of claim 2, wherein said lever is pivoted against a spring force exerted by the contact point of said microswitch.

5. The device of claim 2 wherein the ink deposit is supplied by an ink distribution pipe disposed in close proximity to the ink supply roller whereby upon actuation of the microswitch, an ink supply pump supplies ink to the ink distribution pipe.

* * * * *